US010190842B2

(12) United States Patent
Yoshida et al.

(10) Patent No.: US 10,190,842 B2
(45) Date of Patent: Jan. 29, 2019

(54) TOY PROJECTILE LAUNCH SYSTEM

(71) Applicant: Mattel, Inc., El Segundo, CA (US)

(72) Inventors: Riki Yoshida, Gardena, CA (US); Christopher R. Colangelo, Van Nuys, CA (US)

(73) Assignee: Mattel, Inc., El Segundo, CA (US)

( * ) Notice: Subject to any disclaimer, the term of this patent is extended or adjusted under 35 U.S.C. 154(b) by 82 days.

(21) Appl. No.: 14/681,997

(22) Filed: Apr. 8, 2015

(65) Prior Publication Data

US 2016/0298923 A1 Oct. 13, 2016

(51) Int. Cl.
*F41B 7/08* (2006.01)

(52) U.S. Cl.
CPC ..... *F41B 7/08* (2013.01)

(58) Field of Classification Search
CPC .... A63H 27/004; A63H 27/14; A63H 27/005; A63H 27/06; A63H 17/006; A63H 17/008; A63H 69/407; F41B 7/08; F41B 11/89
See application file for complete search history.

(56) References Cited

U.S. PATENT DOCUMENTS

| | | | | |
|---|---|---|---|---|
| 1,136,470 A | | 4/1915 | Lefever | |
| 1,257,501 A | | 2/1918 | Lefever | |
| 1,381,639 A | | 6/1921 | Hess | |
| 1,509,257 A | | 9/1924 | Randall | |
| 1,597,532 A | | 8/1926 | Mentzer | |
| 2,099,957 A | | 11/1937 | Graham | |
| 2,423,448 A | | 7/1947 | Haight | |
| 2,570,584 A | | 10/1951 | Miskin et al. | |
| 2,735,221 A | * | 2/1956 | Fields | A63H 17/006 124/29 |
| 2,860,620 A | | 11/1958 | Effinger, Jr. | |
| 2,937,638 A | | 5/1960 | Rauglas | |
| 2,957,468 A | | 10/1960 | Enfield | |
| 2,976,644 A | | 3/1961 | Crisci | |
| 3,031,797 A | | 5/1962 | Gelfand | |
| 3,045,392 A | | 7/1962 | Martin | |
| 3,084,477 A | | 4/1963 | Whatley | |
| 3,085,363 A | * | 4/1963 | Sunrsy | A63H 27/00 124/16 |
| 3,148,478 A | * | 9/1964 | Miller | A63H 17/006 124/26 |

(Continued)

*Primary Examiner* — Melba Bumgarner
*Assistant Examiner* — Amir Klayman
(74) *Attorney, Agent, or Firm* — Sheppard, Mullin, Richter & Hampton LLP

(57) ABSTRACT

A toy projectile launch system comprises a launch base, a projectile and an activating device. The launch base may comprise a lever having first and second ends and a fulcrum. The lever may be pivotally movable between restricted and unrestricted states and biased to the restricted state. The projectile may comprise a resilient member and a receiving surface. The resilient member may be configured for biased engagement with the launch base. The second end of the lever may engage the receiving surface when the lever is in the restricted state and disengage from the receiving surface when the lever is in the unrestricted state. The activating device may be removably coupled to the launch base by engagement of a mating pair. One of the mating pair may is on the activating device and the other one of the mating pair is on the launch base.

16 Claims, 12 Drawing Sheets

(56) References Cited

U.S. PATENT DOCUMENTS 3,154,062 A * 10/1964 Ryan ..... F41B 7/02 124/16
3,496,671 A * 2/1970 Korona ..... A63H 27/14 124/21
3,603,024 A 9/1971 Davis et al.
3,693,282 A * 9/1972 Adicks ..... A63H 17/008 446/430
3,774,586 A * 11/1973 Saito ..... F41B 7/08 124/29
3,895,459 A 7/1975 Morrison et al.
3,918,197 A * 11/1975 Stanzel ..... A63H 27/14 446/65
3,974,819 A 8/1976 Held
4,060,930 A 12/1977 Hirtle et al.
4,167,830 A * 9/1979 Ogawa ..... A63H 33/003 273/142 R
4,236,345 A * 12/1980 Inoue ..... A63H 17/006 446/197
4,282,675 A 8/1981 Stripling, Jr.
4,345,402 A * 8/1982 Hanson ..... A63H 29/00 124/31
4,423,871 A 1/1984 Mucaro
4,501,567 A 2/1985 Cathell
4,715,602 A 12/1987 May et al.
4,723,931 A * 2/1988 Allen ..... A63H 3/16 446/268
5,129,852 A 7/1992 Crisci et al.
5,674,105 A 10/1997 Hamlin
6,179,680 B1 1/2001 Hornsby et al.
6,612,298 B2 * 9/2003 Mendoza-Orozco ..... F41B 11/642 124/37
6,631,709 B2 10/2003 Carter et al.
6,736,124 B2 5/2004 Carter
6,752,682 B1 * 6/2004 Ferrell ..... A63H 27/005 124/16
7,077,359 B2 7/2006 Poesch et al.
7,146,973 B2 12/2006 Seekman et al.
7,216,642 B2 5/2007 Poesch et al.
7,398,776 B2 7/2008 Casas Salva
7,665,455 B2 2/2010 Salva
7,673,624 B2 * 3/2010 Rosella, Jr. ..... A63F 9/02 124/10
7,682,218 B2 3/2010 Yu et al.
7,686,669 B2 * 3/2010 Sun ..... A63H 3/28 446/175
7,811,151 B2 10/2010 Conrad
7,901,266 B2 3/2011 Ostendorff
8,132,651 B2 3/2012 Sink et al.
8,939,136 B2 * 1/2015 Gaus ..... F41F 7/00 124/4
9,097,484 B2 * 8/2015 Poirier ..... F41B 7/08
9,345,976 B2 5/2016 Li et al.
2005/0009440 A1 1/2005 Foster et al.
2006/0272627 A1 * 12/2006 Martinez ..... F41B 7/08 124/16
2007/0023023 A1 * 2/2007 Rosella, Jr. ..... A63F 9/02 124/16
2008/0096460 A1 * 4/2008 Sandoval ..... A63H 17/008 446/279
2008/0276921 A1 11/2008 Casas Salva
2009/0071456 A1 * 3/2009 Chia ..... F41B 7/08 124/16
2011/0226225 A1 * 9/2011 Corsiglia ..... F41A 19/59 124/16
2013/0239935 A1 * 9/2013 Martinez ..... F41B 3/04 124/4
2014/0060509 A1 3/2014 Tseng
2014/0090630 A1 * 4/2014 Bird ..... F41B 7/08 124/31

* cited by examiner

TOY PROJECTILE LAUNCH SYSTEM

FIELD OF THE INVENTION

This invention relates to a toy projectile launch system and, in particular, to a toy projectile launch system that may be actuated between restricted and unrestricted states in cooperation with a separate activating device to launch one or more projectiles in the unrestricted state.

BACKGROUND

There are a variety of toys on the market that perform the function of firing a missile or other projectile. Such toys may include toy guns and vehicles that can launch projectiles, such as foam darts or water.

Children often utilize these toys in the exercise of their imagination, often enacting scenes of combat or battle. Because of the simple one-step nature of these toys, however, a child may become easily bored and quickly lose interest.

Thus, a more complex mechanism for such toys may be desired to provide further engagement of a child's imagination.

BRIEF SUMMARY

In one embodiment, a toy projectile launch system is provided. The toy projectile launch system comprises a launch base, a projectile and an activating device. The launch base comprises a switch that actuates a stop between a restricted state and an unrestricted state. The projectile comprises a receiving surface. When the projectile is coupled to the launch base, the stop may be engaged with the receiving surface. When the switch is in the restricted state and the stop may be disengaged from the receiving surface when the switch is in the unrestricted state. The activating device may be configured to be coupled to the launch base. When the activating device is coupled to the launch base, the switch may actuate the stop to the unrestricted state. When the activating device is removed from the launch base, the switch may actuate the stop to the restricted state.

In another embodiment, a toy projectile launch system is provided. The toy projectile launch system comprises a launch base, a projectile and an activating device. The launch base may comprise a switch that may actuate between a restricted state and an unrestricted state. The launch base may also comprise a trigger. The projectile may comprise a resilient member in biased engagement with the launch base. The projectile may be launched from the launch base when the resilient member is urged from biased engagement with the launch base and the switch is in the unrestricted state. The activating device may be configured to be coupled to the launch base. When the activating device is coupled to the launch base, the switch may be actuated to the unrestricted state. When the activating device is removed from the launch base, the switch may be actuated to the restricted state.

In a further embodiment, a toy projectile launch system is provided. The toy projectile launch system comprises a launch base, a projectile and an activating device. The launch base may comprise a lever having first and second ends and a fulcrum between the first and second ends. The lever may be pivotally movable between a restricted state and an unrestricted state. The lever may be biased to the restricted state. The projectile may comprise a resilient member and a receiving surface. The resilient member may be configured for biased engagement with the launch base. The second end of the lever may engage the receiving surface when the lever is in the restricted state and the second end of the lever may disengage from the receiving surface when the lever is in the unrestricted state. The activating device may be configured to be removably coupled to the launch base by engagement of a mating pair. One of the mating pair may be provided on the activating device and the other one of the mating pair may be provided on the launch base. Engagement of the mating pair may pivotally move the lever from a restricted state to an unrestricted state.

Other objects, features and advantages of the described preferred embodiments will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Preferred and non-limiting embodiments of the inventions may be more readily understood by referring to the accompanying drawings in which.

Like numerals refer to like parts throughout the several views of the drawings.

DETAILED DESCRIPTION OF THE EXEMPLARY EMBODIMENTS

Specific, non-limiting embodiments of the present invention will now be described with reference to the drawings. It should be understood that such embodiments are by way of example only and merely illustrative of but a small number of embodiments within the scope of the present invention. Various changes and modifications obvious to one skilled in the art to which the present invention pertains are deemed to be within the spirit, scope and contemplation of the present invention as further defined in the appended claims.

Figure 1:
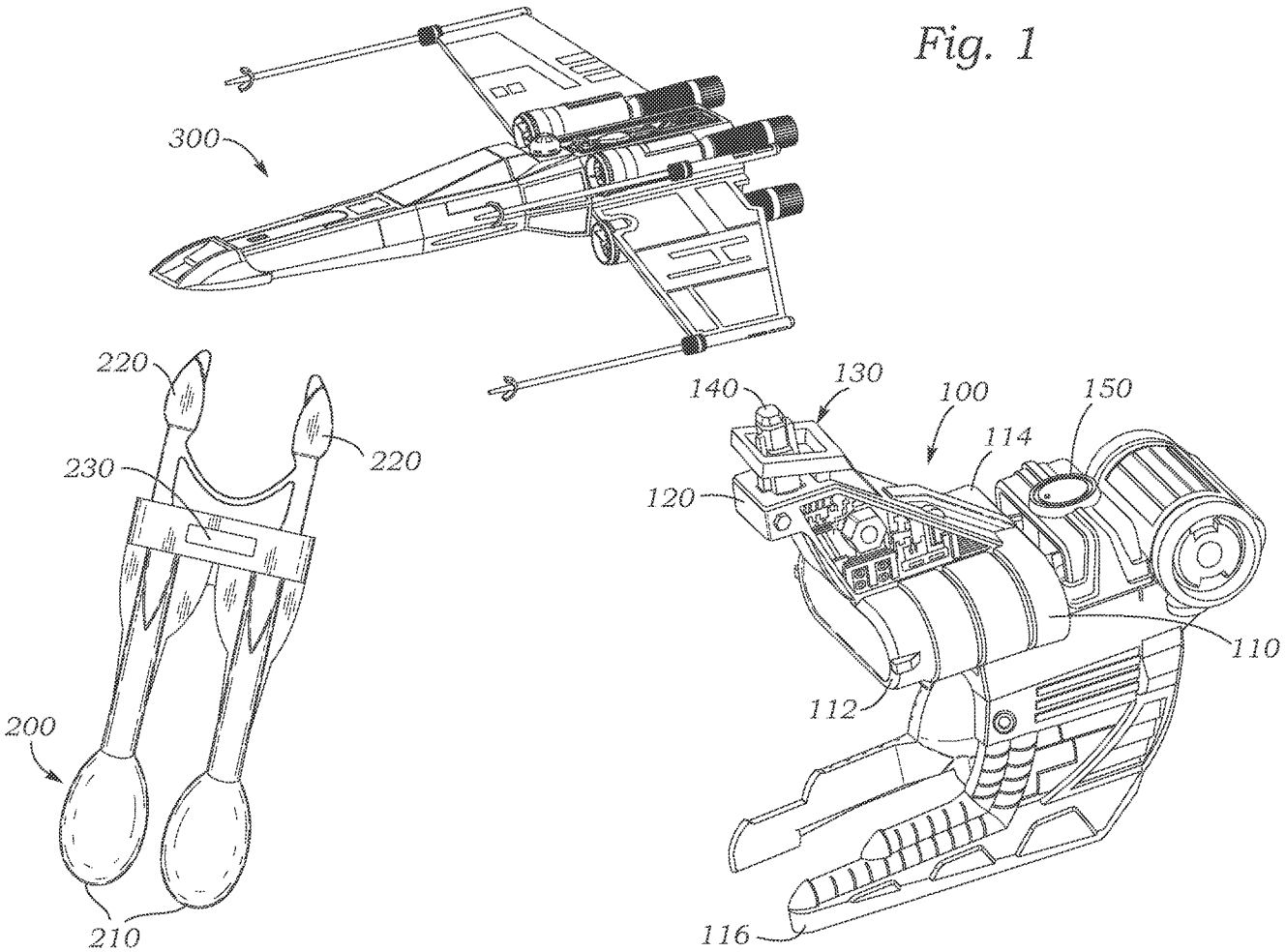
FIG. 1 is a perspective view separately showing the launch base, the projectile and the activating device of the toy projectile launch system.

FIG. 1 depicts an exemplary embodiment of the toy projectile launch system comprising three separate components: a launch base 100, a projectile 200 and an activating device 300. The launch base 100 may be configured to removably couple both the projectile 200 and the activating device 300. The projectile 200 is depicted as comprising a pair of heads 210 on one end, a pair of resilient members 220 on the opposing end and a receiving surface 230 between the heads 210 and the resilient members 220. The receiving surface 230 may be formed as a recess or a slot in the body of the projectile 200. The activating device 300 may be formed in any variety of shapes and sizes, such as an airplane, a spaceship, a car, a train, etc., so long as the activating device 300 is capable of coupling the launch base 100, as discussed in greater detail below.

Figure 2:
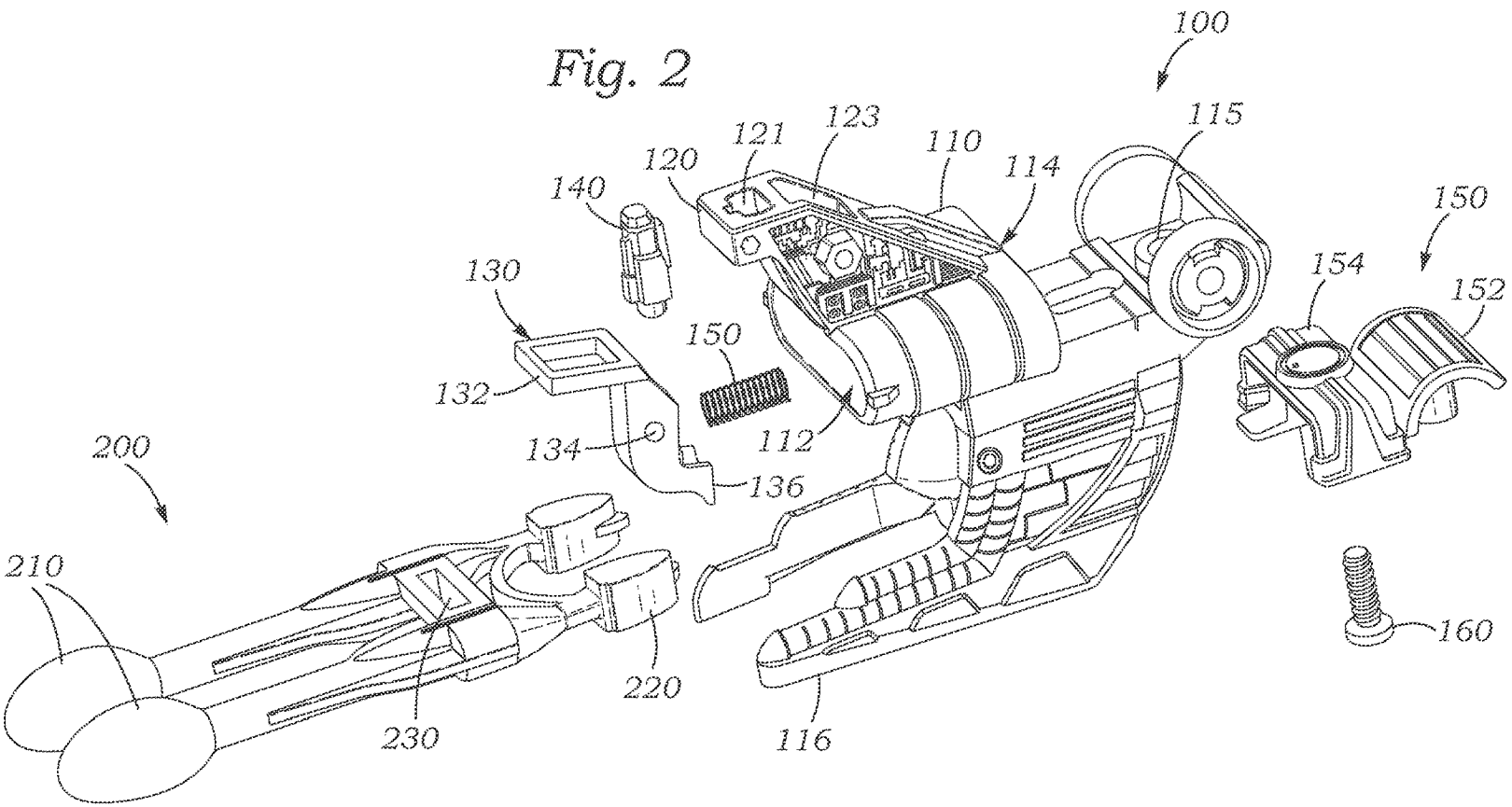
FIG. 2 is an exploded perspective view of the projectile and the launch base.
Figure 3A:
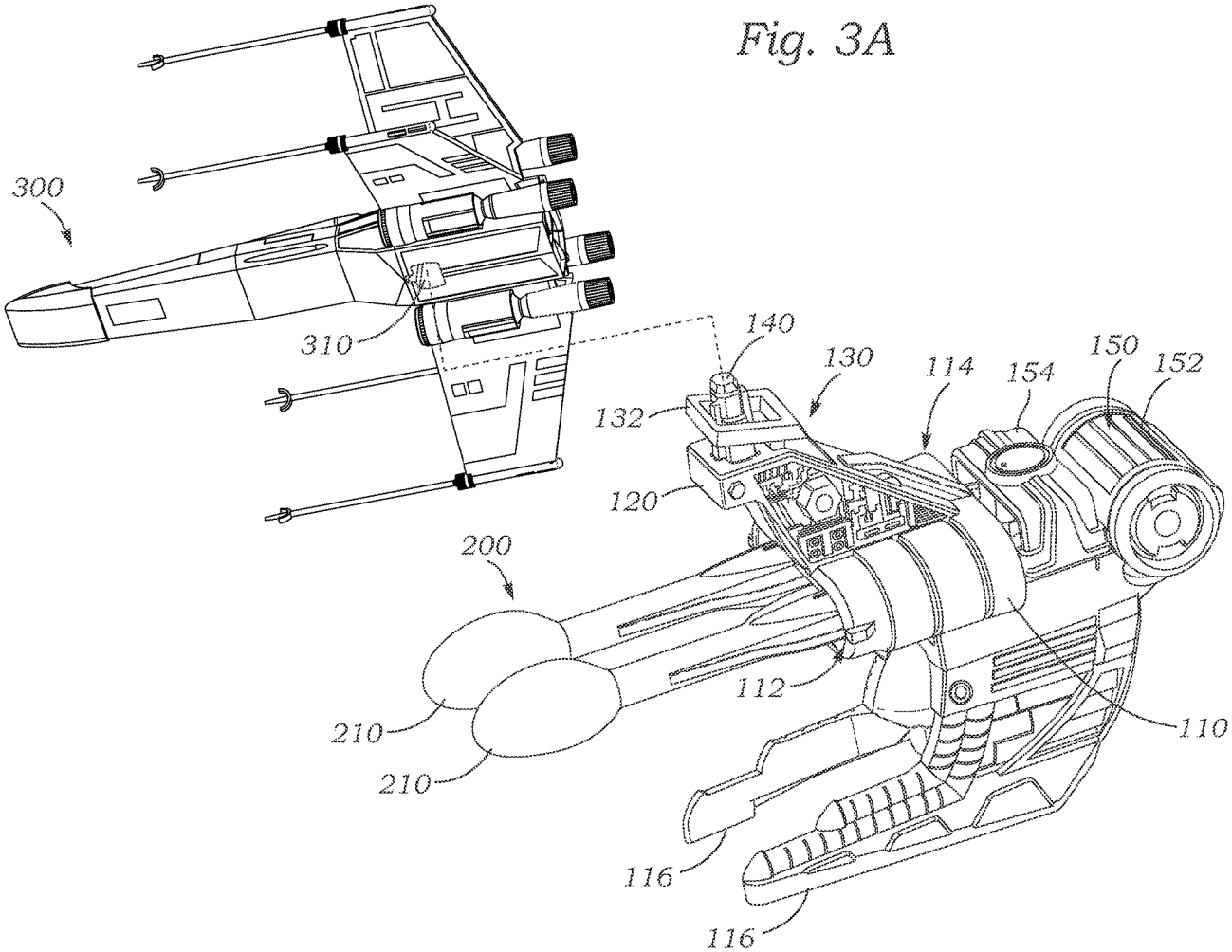
FIGS. 3A-3B are perspective views showing the coupling of the activating device and the launch base, wherein the launch base includes a coupled projectile.
Figure 3B:
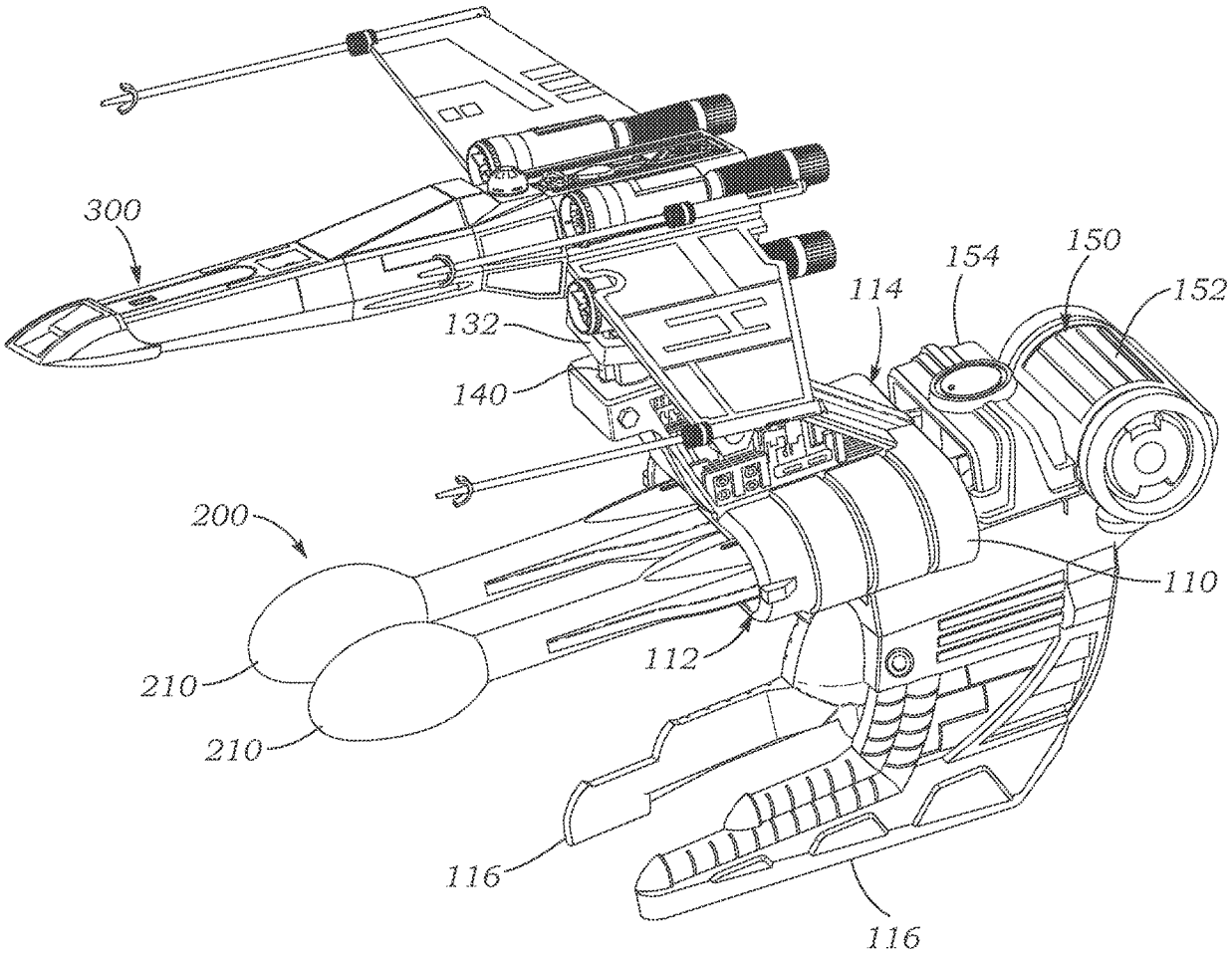
Figure 6:
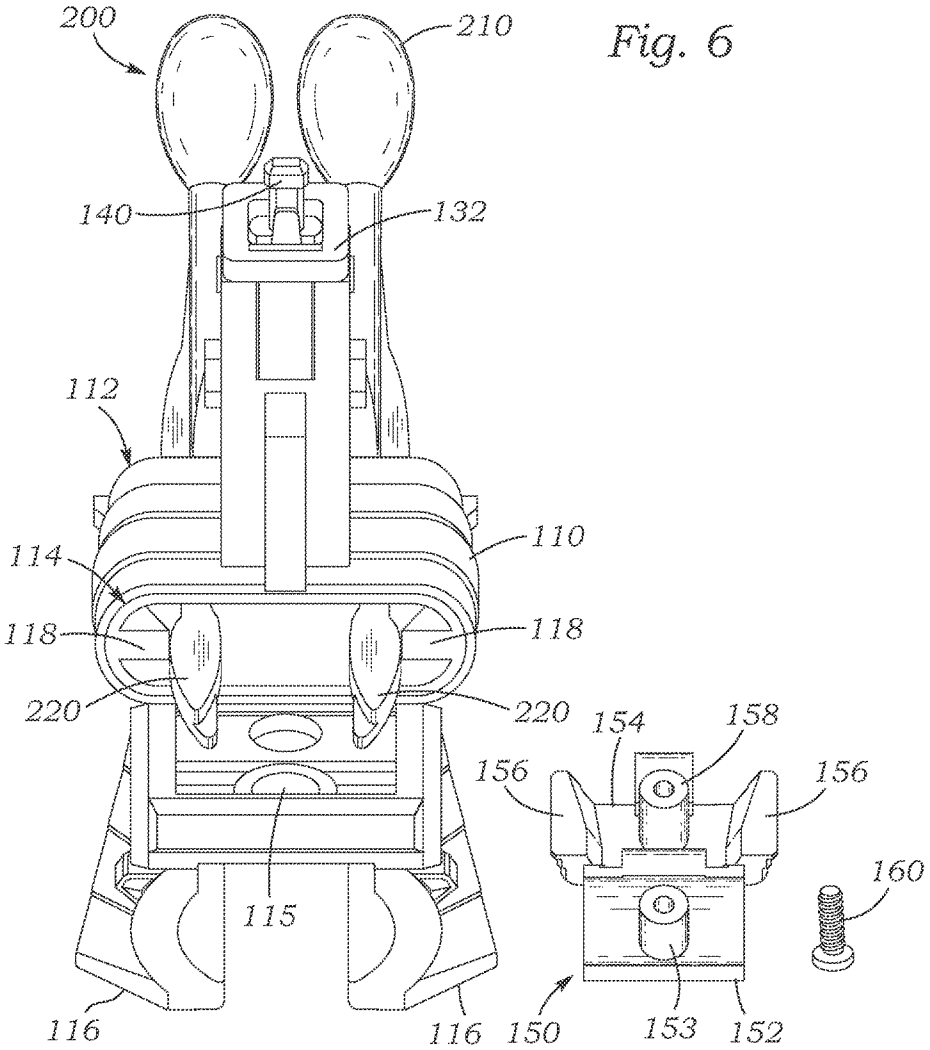
FIG. 6 is a top rear perspective view of the launch base with a projectile.

FIG. 2 shows one set of exemplary components that may comprise the launch base 100. As illustrated, the launch base 100 comprises a housing or a sleeve 110 having a first end 112, through which a projectile 200 may be inserted and a second end 114 through which a portion of the projectile resilient member 220 may be exposed. The sleeve 110 includes a cavity that is sized to accommodate at least a portion of the projectile 200, as shown in FIGS. 3A, 3B and 6.

Figure 4B:
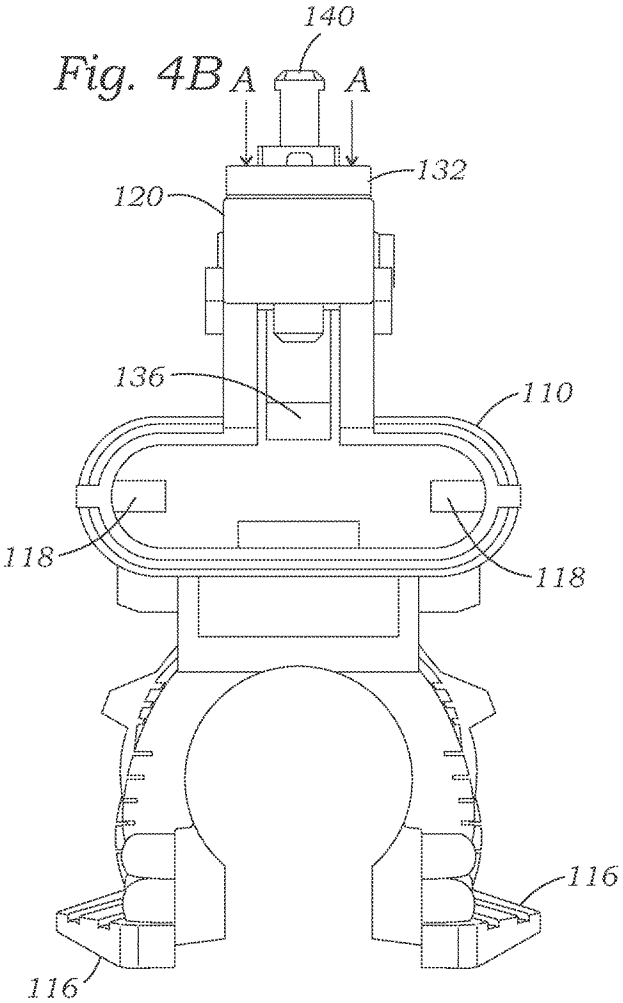
FIGS. 4A-4B are rear plan views of the launch base showing actuation of the switch between a restricted state (FIG. 4A) and an unrestricted state (FIG. 4B).
Figure 4A:
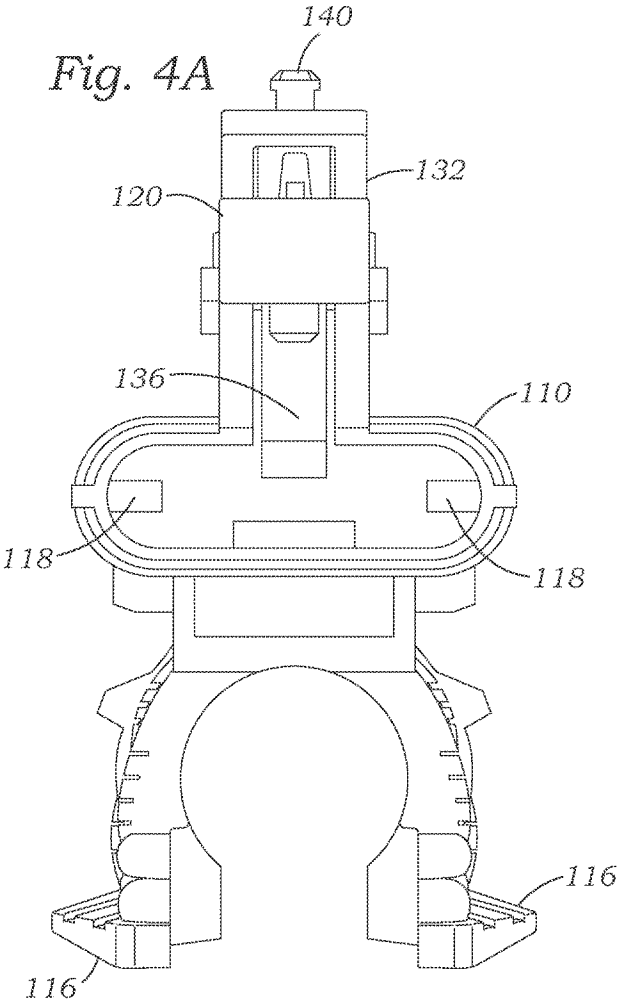

A housing 120 provided on top of the sleeve 110 couples with the switch assembly 130. In some embodiments, the switch assembly 130 is provided as a lever comprising a first end 132 that is exposed from an opening 123 in the housing, a second end 136 and a fulcrum 134 disposed between the first end 132 and the second end 136. As shown in FIGS. 4A and 4B, the switch assembly 130 may be actuated between a restricted state (FIG. 4A) and an unrestricted state (FIG. 4B). A biasing member, such as a spring 150, may be provided to bias the switch assembly 130 to one of a restricted state or an unrestricted state by exerting a lateral force onto the switch assembly 130, depending on the side of the fulcrum 134 onto which the lateral force is applied. In some embodiments, the spring 150 may apply a force onto the switch assembly 130 on the side of the fulcrum 134 that is closest to the second end 136 to bias the switch assembly 130 to the restricted state. In other embodiments, the spring 150 may apply a force onto the switch assembly 130 on the side of the fulcrum 134 that is closest to the first end 132 to bias the switch assembly 130 to the unrestricted state.

FIGS. 4A-4B depict the embodiment in which the switch assembly 130 is biased to the restricted state. As depicted in FIG. 4A, the spring 150 applies a lateral force onto the switch assembly 130 on the side closest to the second end 136 to urge the second end 136 to jut into the cavity of the sleeve 110. This, in turn, causes the first end 132 to protrude upwardly of the housing 110. As depicted in FIG. 4B, a downward force A may be applied to the first end 132 that is sufficient to overcome the lateral force of the spring 150 to cause the switch assembly 130 to pivot about the fulcrum 134 such that the second end 136 is retracted from the cavity of the sleeve 110. This will provide a clear passageway for launching a projectile 200 out of the sleeve 110 of the launch base 100.

Figure 5:
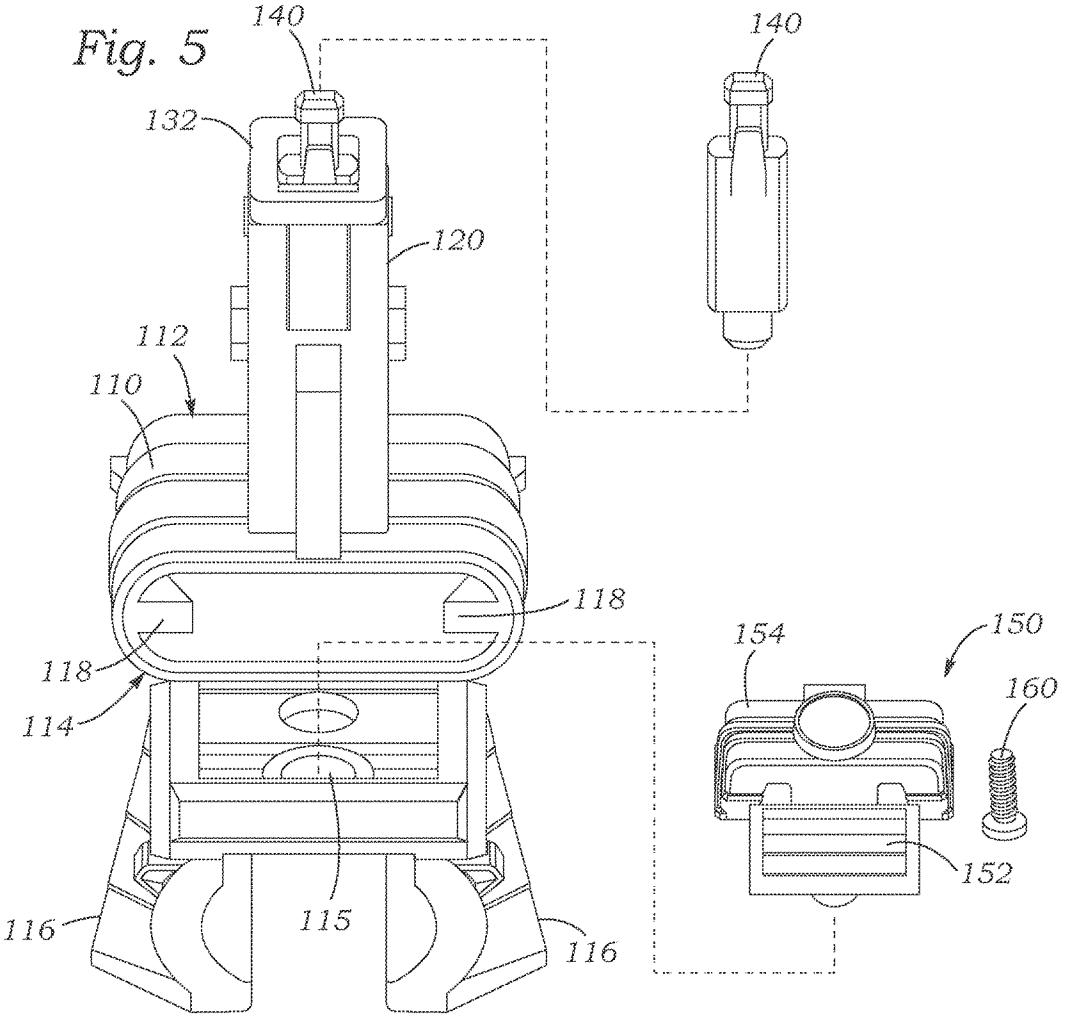
FIG. 5 is an exploded perspective view of the launch base showing the assembly of one of a mating pair configured to engage the activating device and a trigger configured to engage the projectile.

The projectile 200 is sized and shaped to slidably fit within the sleeve 110 of the launch base 100, with the resilient members 220 leading into the first end 112 and projecting out of the second end 114. As shown in FIGS. 4A, 4B and 5, the sleeve 110 comprises a pair of tabs 118 projecting inwardly into the cavity of the sleeve 110. The tabs 118 narrow the opening defined by the second end 114 and provides an engagement edge that contacts the resilient members 220 of the projectile 200.

As the projectile 200 is inserted through the first end 112 and out the second end 114, the resilient members 220 are urged towards one another as they pass through the second end 114 that is narrowed by the tabs 118. The tabs 118 may be shaped in form of a ramp or wedge to allow the resilient members 220 to slide smoothly and to provide a gradual narrowing of the passageway as they are urged together. Once the resilient members 220 clears the tabs, they may resiliently spring to their original state to fixedly retain the projectile 200 in the launch base 100 and prevent it from sliding out of the sleeve 110. FIG. 6 depicts the resilient members 220 in cooperation with the tabs 118 to couple the projectile within the launch device 100.

The projectile 200 may also be fixedly retained by engagement of the second end 136 of the switch assembly 130 with the receiving surface 230 of the projectile 200, such that the second end 136 functions as a stop. In one embodiment, the second end 136 may protrude into the receiving surface 230 to retain the projectile 200 and prevent it from sliding out of the sleeve 110. In another embodiment, the second end 136 may be shaped to permit the projectile 200 to slidably move in a single direction as it is being inserted into the sleeve 110 until the second end 136 engages the receiving surface 230. Thus in accordance with these embodiments, once the projectile 200 is housed within the sleeve 110 with the resilient members 220 in cooperation with the tabs 118 and the second end 136 of the switch assembly 130 engaged in the receiving surface 230, the projectile 200 is fixedly maintained within the sleeve 110 and prevented from slidably moving out of the sleeve 110.

The launching of the projectile 200 out of the launch base 100 may be accomplished based on one or more specific conditions being met. In one embodiment, one of the specific conditions is that the switch assembly 130 is in the unrestricted state, as shown in FIG. 4B, which may be accomplished by coupling an activating device 300 to the launch base 100. Thus, the activating device 300 may be coupled to the launch base 100 in such a manner that it exerts and maintains the required downward force A onto the first end 132 of the switch assembly to move the second end 136 out of engagement with the receiving surface 230 of the projectile 200.

As shown in FIGS. 3A-3B, the activating device 300 may be coupled to the launch base 100 by engagement of a mating pair. The activating device 300 may comprise one of the mating pair in form of a recess 310 and the launch device may comprise the other one of the mating pair in form of a protrusion 140. The recess 310 and the protrusion 140 are shaped such that they may be securely snap fit to removably secure the activating device 300 and the launch base 100 together. Engagement of the mating pair may pivotally move the switch assembly 130 from the restricted state to the unrestricted state. In one embodiment, the first end 132 of the switch assembly 130 is adjacent to the protrusion 140. In another embodiment, the first end 132 forms an opening within which the protrusion 140 is maintained such that the first end 132 may freely move relative to the protrusion 140 to actuate the switch assembly 130 between the restricted and unrestricted states. It is understood that the activating device 300 may comprise the protrusion and the launch base 100 comprise the corresponding recess.

The projectile 200 is ready to be launched from the launch base 100 once the activating device 300 is coupled to the launch base 100 to actuate the switch assembly 130 to the unrestricted state. In one embodiment, the projectile 200 may be launched out the first end 112 of the sleeve 110 by activating a trigger 150 disposed adjacent the second end 114 of the sleeve 110. FIGS. 5 and 6 depict the trigger 150 as comprising a fixed end 152 and a free end 154 coupled to the fixed end 152 via a living hinge. The fixed end 152 is coupled to the launch base 100 by passing a screw 160 through the opening 115 and the corresponding bore 153 of the fixed end 152. At least a portion of the resilient members 220 of the projectile 200 is housed within a cavity formed by the trigger 150, which comprises shaped edges 156. The shaped edges 156 are configured to apply a force to urge the resilient members 220 together such that the projectile 200 is forcibly propelled out of the sleeve 110 by the biasing force of the resilient members 220 outwardly against the tabs 118. In one embodiment, the shaped edges 156 are shaped to provide a gradually increasing force urging the resilient members 220 together. In another embodiment, the shaped edges 156 are formed as a ramp on the underside of the free end 154 proximate the resilient members 220 such that a gradually increasing force is applied as the free end 154 is depressed downwardly. Once the resilient members 220 are sufficiently narrowed, the tabs 118 are angled to provide a decreasing ramp from the second end 114 towards the first end 112 disposed on the sleeve 110 helps propel the projectile 200 out of the launch base 100 under the biasing force of the resilient members 220 against the angled tabs 118.

In some embodiments, the receiving surface may be located on an underside of the projectile. In some of these embodiments, the switch assembly may be provided as a post or similar mechanism comprising a first end and a second end attached to the inside of the launch base via a living hinge. The living hinge biases the switch assembly and its first and second ends into an elevated restricted state. When a force is applied onto the first end against the bias of the living hinge, the switch assembly, including the second end, actuates into a lowered unrestricted state where the second end moves out of engagement with the receiving surface of the projectile.

Figure 7A:
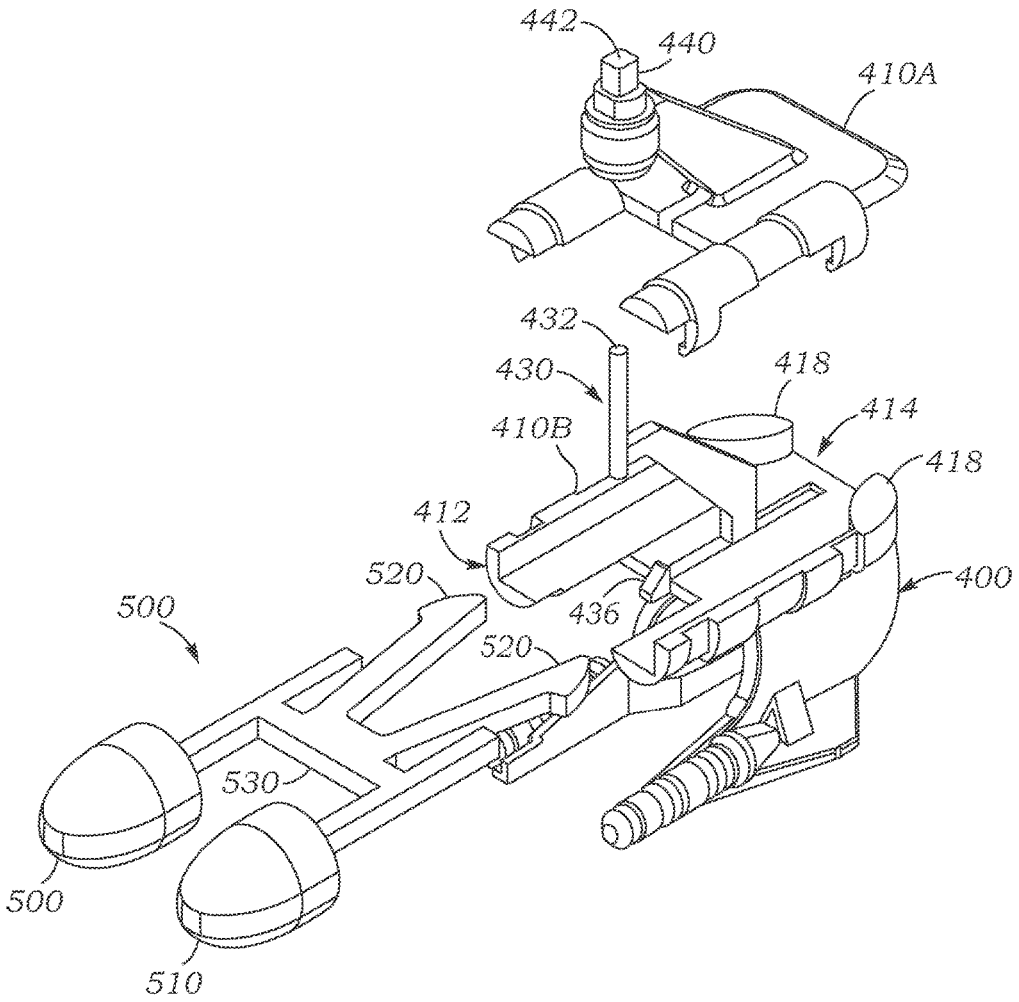
FIGS. 7A-7C depict various views of another embodiment of the launch base and projectile, with FIG. 7A depicting an exploded perspective view, FIG. 7B depicting a top view and FIG. 7C depicting an exploded side view.
Figure 7B:
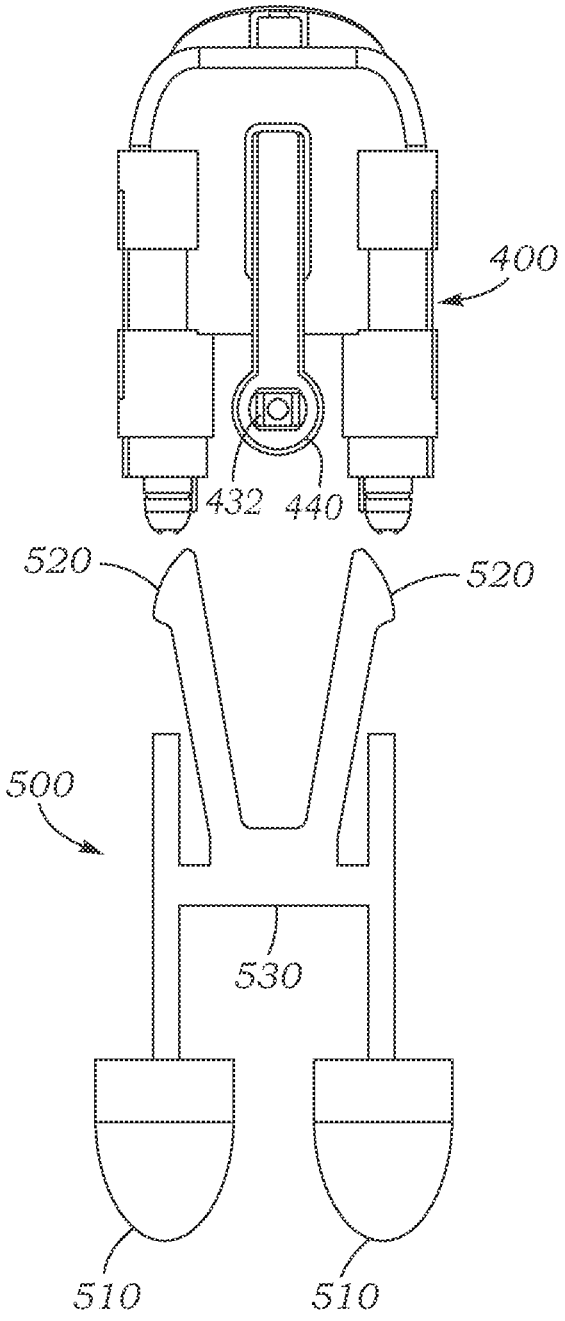
Figure 7C:
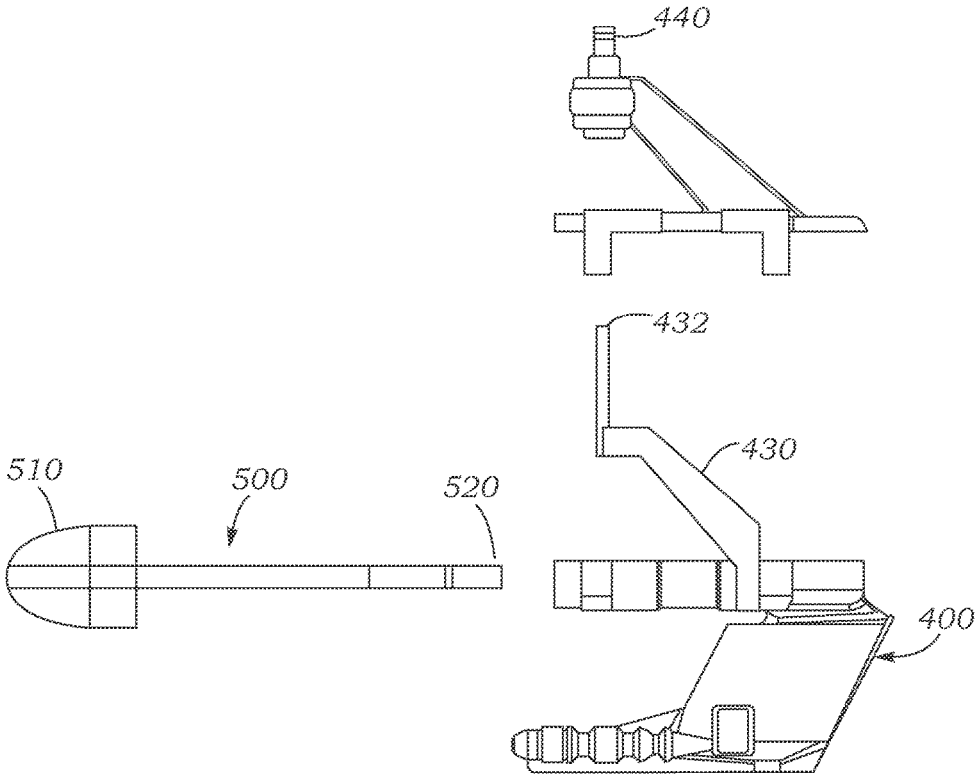

FIGS. 7-9 depict an exemplary embodiment comprising a launch base 400 and a projectile 500. The launch base 400 is configured to removably couple an activating device of the type illustrated in FIGS. 1, 3A and 3B, not illustrated here, and the projectile 500. The launch base 400 comprises a housing that may be formed by joining an upper portion 410A and a lower portion 410B to form a cavity therebetween to receive at least a portion of the projectile 500. The projectile 500 may be loaded through a first end 412 to expose at least a portion of the resilient members 520 from a second end 414.

The second end 414 may include a pair of tabs 418 that project or are angled towards one another from opposing sides of the housing. The tabs 418 narrow the opening defined by the second end 414 and provide an engagement edge that contacts the resilient members 520 of the projectile 500. Thus, as the projectile 500 is inserted through the first end 412 and out the second end 414, the resilient members 520 are urged towards one another as they pass through the second end 414 narrowed by the tabs 418. The surface of the tabs 418 that contact the resilient members 520 of the projectile 500 may have a smooth, angled or ramped shape to allow the resilient members 520 to slide smoothly as they are urged together. Once the resilient members 520 clear the tabs, they may resiliently spring to their original state to securely retain the projectile 500 in the launch base 400.

A switch assembly 430 is resiliently coupled to the launch base 400. FIGS. 8B and 9B illustrate the cooperation between the switch assembly 430 and the launch base 400. The switch assembly 430 generally comprises a first end 432 that is exposed from an opening 440 of the launch base 400 and a second end 436 that is resiliently biased to protrude into or out of the cavity formed between the upper and lower portions 410A, 410B. In the embodiment depicted in FIGS. 7-9, the second end 436 is resiliently biased to protrude into the cavity by a living hinge or connector 437 that is integrally formed with the launch base 400, as depicted in FIGS. 8B and 9B. Alternatively, the second end 436 may be connected or coupled to the launch base 400 by a hinge or pivot that is separately provided.

Figure 8A:
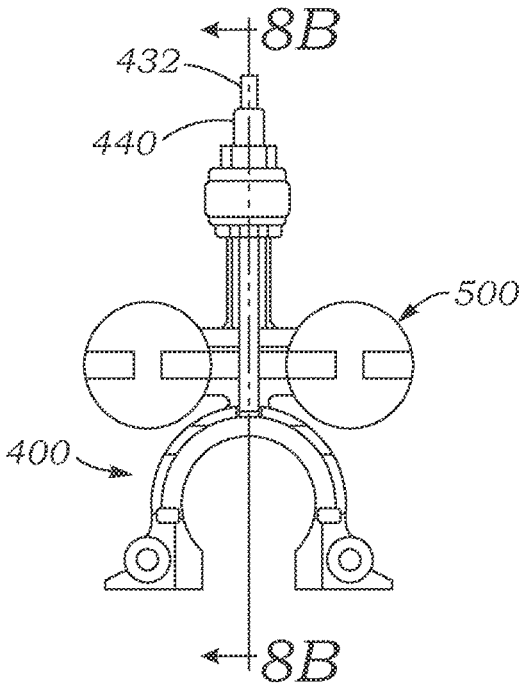
FIGS. 8A-8B depict the launch base with the switch in a restricted state, with FIG. 8A depicting a front plan view and FIG. 8B depicting a cross-sectional view along 8B-8B of FIG. 8A.
Figure 8B:
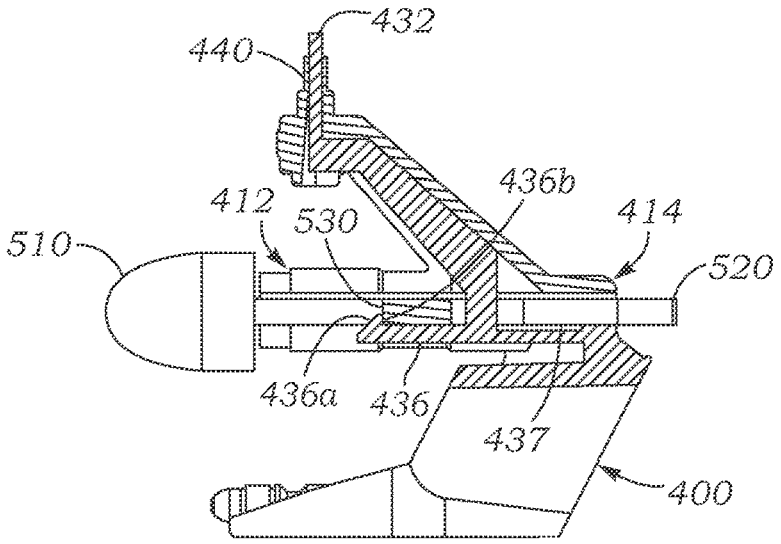
Figure 9A:
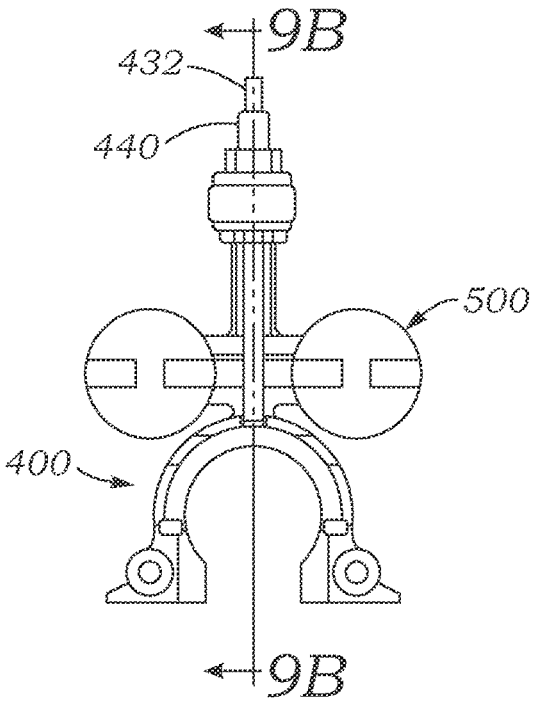
FIGS. 9A-9B depict the launch base with the switch in an unrestricted state, with FIG. 9A depicting a front plan view and FIG. 9B depicting a cross-sectional view along 9B-9B of FIG. 9A.
Figure 9B:
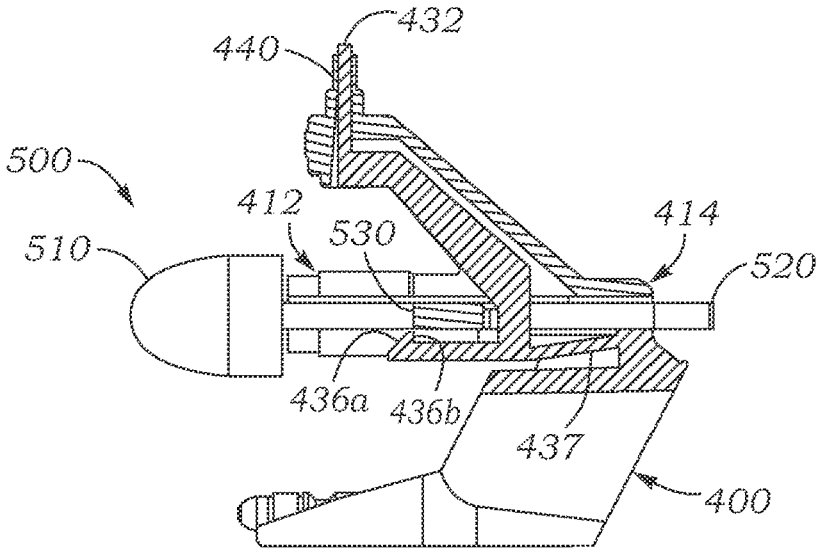

FIGS. 8-9 illustrate the actuation of the switch assembly 430 between a restricted state (FIGS. 8A-8B) and an unrestricted state (FIGS. 9A-9B).

FIGS. 8A-8B illustrate the switch assembly 430 in the restricted state, in which the first end 432 is depicted as protruding out of the opening 440 of the launch base 400 and the second end 436 is depicted as jutting into the cavity defined by the housing 410A, 410B to contact the receiving surface 530 and to thereby fixedly retain the projectile 500 within the cavity. In contrast to the embodiments depicted in FIGS. 4A-4B above, the second end 436 juts into the cavity from the lower portion 410 to contact the receiving surface 530 from the underside of the projectile 500. As can be seen, the living hinge 437 that integrally couples the second end 436 to the launch base 400 resiliently biases the first end 432 upwardly and out of the opening 440 and biases the second end 436 upwardly to jut into the cavity and contact the receiving surface 530. The second end 436 is depicted as having an forward angled or ramped surface 436*a* or ramp to permit the sliding movement of the projectile 500 in one direction, from the first end 412 to the second end 414. The second end 436 is also depicted as having rearward surface 436*b* to restrict the sliding movement of the projectile 500 from the second end 414 to the first end 412 once the rearward surface 436*b* of the second end 436 contacts the receiving surface 530.

FIGS. 9A-9B illustrate the switch assembly 430 in the unrestricted state. In certain embodiments, the switch assembly 430 is actuated to the unrestricted state when the first end 432 is depressed downwardly into the opening 440 of the launch base 400. The first end 432 may be depressed manually or by coupling the activating device 300 to the launch base 400 in a similar manner depicted in FIGS. 3A-3B, provided that the coupling results in the depression of the first end 432. Once the first end 432 is depressed, the living hinge 437 is similarly biased downwardly to retract the second end 436 out of the cavity. This permits the sliding movement of the projectile 500 from the second end 414 to the first end 412 and thus the launching of the projectile 500 out of the launch base 400. It is understood that the launching of the projectile 500 can be accomplished by any means that biases the pair of resilient members 520 together, including the means as described in FIGS. 1-6 above.

It is to be understood that the detailed description and specific examples, while indicating preferred embodiments of the present disclosure, are given by way of illustration and not limitation. Many changes and modifications within the scope of the present disclosure may be made without departing from the spirit thereof, and the disclosure includes all such modifications.

The invention claimed is:

1. A toy projectile launch system comprising:

a launch base comprising a switch movable between a restricted state and an unrestricted state, a biasing member configured to bias the switch to the restricted state, a stop configured to be moved by the switch when the switch is moved from the restricted state to the unrestricted state, and a trigger assembly separate from the switch and comprising a fixed portion movably coupled to a free portion;

a projectile comprising a resilient member configured to removably couple the projectile to the launch base; and a receiving surface configured to receive the stop when the projectile is coupled to the launch base and the switch is in the restricted state; and an activating device configured to be removably coupled to the launch base;

wherein coupling the activating device to the launch base causes the switch to move to the unrestricted state;

wherein removing the activating device from the launch base causes the biasing member to return the switch to the restricted state;

wherein, when the switch is in the unrestricted state and the projectile is coupled to the launch base, the free portion of the trigger assembly is configured to apply a force to the resilient member and launch the projectile when the free portion is moved with respect to the fixed portion; and wherein, when the switch is in the restricted state and the projectile is coupled to the launch base, the stop prevents the free portion of the trigger assembly from launching the projectile when the free portion is moved with respect to the fixed portion.

2. The toy projectile launch system of claim 1, wherein, when the projectile is coupled to the launch base, the resilient member is in biased engagement with the launch base.

3. The toy projectile launch system of claim 2, wherein, when the switch is in the unrestricted state and the projectile is coupled to the launch base, movement of the free portion with respect to the fixed portion urges the resilient member out of biased engagement with the launch base and launches the projectile.

4. The toy projectile launch system of claim 1, wherein the switch is a lever having first and second ends and a fulcrum between the first and second ends, wherein the stop is located at the second end.

5. The toy projectile launch system of claim 4, wherein the stop is a protrusion and the receiving surface is a slot disposed in the projectile, wherein the stop engages the receiving surface when the stop is disposed within the slot and wherein the stop disengages the receiving surface when the stop is removed from the slot.

6. The toy projectile launch system of claim 5, wherein when the activating device is coupled to the launch base, the activating device depresses the first end and the stop is disengaged from the receiving surface of the projectile.

7. A toy projectile launch system comprising:

a launch base comprising a switch movable between a restricted state and an unrestricted state, a biasing member configured to bias the switch to the restricted state, a stop configured to be moved by the switch when the switch is moved from the restricted state to the unrestricted state, and a trigger assembly separate from the switch and comprising a fixed portion movably coupled to a free portion;

a projectile comprising a resilient member in biased engagement with the launch base, and a receiving surface configured to receive the stop when the switch is in the restricted state;

an activating device configured to be removably coupled to the launch base;

wherein coupling the activating device to the launch base causes the switch to move to the unrestricted state;

wherein removing the activating device from the launch base causes the biasing member to return the switch to the restricted state; and wherein, when the switch is in the unrestricted state, the free portion of the trigger assembly is configured to urge the resilient member out of biased engagement with the launch base and launch the projectile from the launch base when the free portion is moved with respect to the fixed portion; and wherein, when the switch is in the restricted state, the stop prevents the free portion of the trigger assembly from launching the projectile when the free portion is moved with respect to the fixed portion.

8. The toy projectile launch system of claim 7, wherein when the activating device is coupled to the launch base, the activating device depresses the switch to move the switch from the restricted state to the unrestricted state.

9. The toy projectile launch system of claim 7, wherein:

the free portion of the trigger assembly comprises a shaped edge; and actuation of the trigger assembly causes the shaped edge to urge the resilient member out of biased engagement with the launch base.

10. A toy projectile launch system comprising:

a launch base comprising a lever having first and second ends and a fulcrum between the first and second ends, wherein the lever is pivotally movable between a restricted state and an unrestricted state, and a biasing member configured to bias the lever to the restricted state;

a projectile comprising a resilient member configured to removably couple the projectile to the launch base, and a receiving surface configured to receive the second end of the lever, wherein the resilient member comprises a pair of prongs and is configured for biased engagement with the launch base, wherein the second end of the lever engages the receiving surface when the projectile is coupled to the launch base and the lever is in the restricted state;

an activating device configured to be removably coupled to the launch base by engagement of a mating pair, wherein one of the mating pair is provided on the activating device and the other one of the mating pair is provided on the launch base, wherein engagement of the mating pair pivotally moves the lever from the restricted state to the unrestricted state, and wherein disengagement of the mating pair causes the biasing member to return the lever to the restricted state; and a trigger button coupled to the launch base and separate from the lever;

wherein, when the lever is in the unrestricted state and the projectile is coupled to the launch base, pressing the trigger button urges the prongs out of biased engagement with the launch base and launches the projectile from the launch base; and wherein, when the lever is in the restricted state and the projectile is coupled to the launch base, the second end of the lever prevents the trigger button from launching the projectile from the launch base.

11. The toy projectile launch system of claim 10, wherein the launch base further comprises a sleeve that is shaped to house the projectile, the sleeve having first and second open ends.

12. The toy projectile launch system of claim 11, wherein:

the prongs are resiliently urged together when inserted inside the sleeve through the first end, and the prongs spring apart when at least a portion of the prongs is exposed from the second end of the sleeve.

13. The toy projectile launch system of claim 12, wherein the trigger button is movable to urge the shaped prongs together and apply a launching force to propel the projectile out of the sleeve when the lever is in the unrestricted state.

14. The toy projectile launch system of claim 10, wherein the mating pair comprises a shaped protrusion and a correspondingly shaped recess, and wherein the mating pair snap fits together.

15. The toy projectile launch system of claim 14, wherein the shaped protrusion is disposed on the launch base adjacent the first end of the lever.

16. The toy projectile launch system of claim 15, further comprising a stop disposed inside the sleeve when the lever is in the restricted state.

* * * * *